US007449985B2

(12) United States Patent
Urano et al.

(10) Patent No.: US 7,449,985 B2
(45) Date of Patent: Nov. 11, 2008

(54) MAGNETIC ELEMENT AND METHOD OF MANUFACTURING MAGNETIC ELEMENT

(75) Inventors: Yuichiro Urano, Sumida-Ku (JP); Fumihito Meguro, Koganei (JP); Yoshio Kawahata, Minamisouma (JP)

(73) Assignee: Sumida Corporation (JP)

( * ) Notice: Subject to any disclaimer, the term of this patent is extended or adjusted under 35 U.S.C. 154(b) by 161 days.

(21) Appl. No.: 11/345,149

(22) Filed: Feb. 1, 2006

(65) Prior Publication Data

US 2006/0170525 A1 Aug. 3, 2006

(30) Foreign Application Priority Data

Feb. 2, 2005 (JP) ..... 2005-026102

(51) Int. Cl.
*H01F 17/06* (2006.01)

(52) U.S. Cl. ..... 336/178; 336/212

(58) Field of Classification Search ..... 336/212, 336/178, 220, 223, 222, 200, 232
See application file for complete search history.

(56) References Cited

U.S. PATENT DOCUMENTS 4,009,460 A * 2/1977 Fukui et al. ..... 336/110
5,748,013 A * 5/1998 Beauclair et al. ..... 336/233
6,873,239 B2 * 3/2005 Decristofaro et al. ..... 336/178

OTHER PUBLICATIONS

Patent Abstract of Japan, Publication No. 2004-103658 published Apr. 2, 2002, NEC Tokin Corp, Appln No. 2002-260316 Sep. 5, 2002 with electronic translations generated by the Japanese Patent Office.

* cited by examiner

*Primary Examiner*—Anh T Mai
(74) *Attorney, Agent, or Firm*—Stephen Chin; von Simson & Chin, LLP

(57) ABSTRACT

A problem to be solved is to stabilize temperature characteristics in various characteristics of a magnetic element. A magnetic element has a coil formed by winding a conductor, EP cores constituted of a magnetic material and passing magnetic flux generated in the coil, a solid part provided between EP cores opposing each other among the EP cores, and having a ceramics material or a resin material, in which the solid part is in contact with opposing faces of the respective opposing EP cores, and the solid part is provided with a thickness dimension ranging from 3 μm to 30 μm.

6 Claims, 12 Drawing Sheets

—— INVENTIVE PRODUCTS: SOLID PART WITH DIMENSION OF APPROXIMATELY 15 μm IS ARRANGED (NUMBER OF EVALUATED PRODUCTS: 5)

------ CONVENTIONAL PRODUCTS: SOLID PART IS NOT FORMED, AND BOTH MAGNETIC CORES ARE DIRECTLY COUPLED (NUMBER OF EVALUATED PRODUCTS: 5)

MAGNETIC ELEMENT AND METHOD OF MANUFACTURING MAGNETIC ELEMENT

CROSS-REFERENCE TO RELATED APPLICATION

This Application claims priority to Japanese Application No. 2005-026102 filed Feb. 2, 2005, the entire disclosure of which is hereby incorporated by reference.

BACKGROUND OF THE INVENTION

1. Field of the Invention

The present invention relates to a magnetic element used for electronic parts such as inductors, noise filters, transformers, and the like and a method of manufacturing the magnetic element.

2. Description of the Related Art

In recent years, regarding electronic equipment and electronic parts, demands for increasing performance, reducing size, improving safety and the like are becoming stronger. Magnetic elements in particular are often used in important application for operating electronic equipment, such as transmitting a signal, rectifying power supply, and the like. Therefore, increasing performance, reducing size, as well as ensuring more safety are demanded.

A large factor of reducing or limiting performance and safety of magnetic elements is temperature variation (also called temperature load) in environment where they are used. For example, when a magnetic element is used under a condition with relatively small temperature load such as a room temperature, a possibility of reducing performance and safety of the magnetic element is small. However, when electronic equipment having the magnetic element is used under a high temperature condition, or when the magnetic element itself is mounted on a power supply circuit or the like involving relatively large current, various characteristics of the magnetic element may often become unstable. In such cases, in the magnetic element, there arises a possibility of causing thermal runaway or malfunction inside a circuit or equipment. Accordingly, in the case where the temperature load is applied to the magnetic element, stability of temperature characteristics is demanded.

Conventionally, there are magnetic elements which have a coil and at least two or more magnetic cores. As such magnetic elements, further, there is a type in which magnetic cores are butted directly with each other. This type of magnetic element is in a state that end faces (bottom faces orthogonal to a magnetic path) of the magnetic cores are in contact with each other. However, when the end faces being butted are observed microscopically, numerous dents and projections resulting from scratching by grinding, baking the surface of magnetic substance, or the like exist on the end faces. Accordingly, the butted end faces are in a state that the end faces are in contact not entirely but partly. Therefore, the magnetic element has a problem such that when it is subjected to temperature load, and then expansion, contraction and the like occur in the magnetic cores, a change occurs in percentage of contact around minute dents and projections, thereby worsening a change due to a temperature in various characteristics (temperature characteristics of various characteristics).

In order to solve the above-described problem, it is effective to flatten the end faces of the magnetic cores as much as possible. Techniques to flatten the end faces include, in addition to accurate cutting, grinding or the like, use of a chemical polishing method or the like. In such cases, the dents and projections on the end faces can be reduced to a height difference of 3 μm in a possible smallest state. However, the above means require high precision in cutting equipment and grinding equipment, and also the time required in a series of processes largely increases. Therefore, in aspects of cost, process time, and the like, it is not easy to adopt these techniques for mass production of the magnetic element. Here, as a technique to solve the above-described problem, for example, one described in Patent document 1 is known.

In a magnetic element described in Japanese Patent Application Laid-open 2004-103658, a gap is formed by means of cutting, grinding, or the like in at least one position among positions in the magnetic core where a magnetic path is formed, and a rare earth magnet, namely, a bond magnet constituted of a mixture of permanent magnet powder and resin is inserted therein. Thus, it attempts to improve temperature characteristics with respect to various characteristics.

However, for the magnetic element disclosed in Patent document 1, processes such as cutting, grinding and the like are required for making the gap in which the bond magnet can be inserted. Moreover, for the magnetic element disclosed in Patent document 1, operations of such processes are needed to be performed on individual parts. Thus, in the magnetic element disclosed in Patent document 1, productivity is quite low. Also, in the magnetic element disclosed in Patent document 1, a permanent magnet is arranged so as to generate magnetic force in the opposite direction of a direction of magnetic flux flowing in a magnetic core such as ferrite or the like. This requires to pay attention to directivity when mounting inductance parts, and moreover, if an input direction of current is reversed, directions of the magnetic flux and the magnetic force become the same, which causes a problem of adversely affecting the temperature characteristics.

The present invention is made in view of the above-described problems, and an object thereof is to provide a magnetic element having stable temperature characteristics and capable of suppressing a change in various characteristics even when a temperature change occurs, and a method of manufacturing the magnetic element.

SUMMARY OF THE INVENTION

In order to solve the above-described problems, a magnetic element according to the present invention has a coil formed by winding a conductor, a plurality of core members constituted of a magnetic material and passing magnetic flux generated by the coil, and a temperature characteristics adjusting means provided between core members opposing each other among the plurality of core members, and having a non-magnetic and insulative material, in which the temperature characteristics adjusting means is in contact with opposing faces of the respective opposing core members, and the temperature characteristics adjusting means is provided with a thickness dimension ranging from 3 μm to 30 μm.

With this structure, since the temperature characteristics adjusting means is arranged between the core members opposing each other, end faces of the core members are both in close contact with the temperature characteristics adjusting means due to the existence of this temperature characteristics adjusting means. Accordingly, it is possible to prevent occurrence of a situation such that the butted core members contact each other only partly and thus a non-contact part occupies the most part. Thus, it is possible to realize stabilization of temperature characteristics in various characteristics of the magnetic element. Also, by ensuring the stabilization of temperature characteristics in various characteristics of the magnetic element, dispersion of temperature characteristics in various characteristics of a product manufactured with the same specification is improved, and thus the quality of this product can be improved. Further, by limiting the thickness dimension of the temperature characteristics adjusting means according to the present invention to 3 μm to 30 μm, the temperature characteristics adjusting means with high precision can be obtained easily at low cost without using precise cutting, grinding, chemical polishing method, and the like. Also, a state that magnetic saturation would not easily occur can be created while suppressing decrease in magnetic permeability.

Also, in another invention, in addition to the above-described invention, the temperature characteristics adjusting means is constituted of a ceramic material. With this structure, the temperature characteristics adjusting means can be formed using a thin film forming technique. Thus, as compared to the case where cutting, grinding, or the like is performed, increase in the number of processes can be suppressed, and reduction in costs can be realized. Also, the temperature characteristics adjusting means can be formed with high precision.

Further, in another invention, in addition to the above-described invention, the temperature characteristics adjusting means is constituted of a resin material. With this structure, the temperature characteristics adjusting means can be formed using a thin film forming technique. Thus, as compared to the case where cutting, grinding, or the like is performed, increase in the number of processes can be suppressed, and reduction in costs can be realized. Also, the temperature characteristics adjusting means can be formed with high precision.

Also, in another invention, in addition to the above-described invention, the temperature characteristics adjusting means is constituted of a mixed material which is mixed from a ceramic material and a resin material. With this structure, the temperature characteristics adjusting means can be mass produced in a single process. Accordingly, as compared to the case where cutting, grinding, or the like is performed, increase in the number of processes and increase in costs can be suppressed, and the temperature characteristics adjusting means can be formed with a highly precise dimension range. Thus, manufacturing costs of the magnetic element can be reduced, and also the quality of temperature characteristics adjusting means can be improved.

Further, in another invention, in addition to the above-described invention, the temperature characteristics adjusting means is constituted of a solid part in a thin film form, and the solid part is provided in closely attached state with the opposing faces of the respective core members. With this structure, the solid part in a thin film form is provided between the core members opposing each other among the plurality of core members. Accordingly, the core members do not contact each other. Thus, it is possible to prevent occurrence of a situation such that when a plurality of core members contact each other, they contact only partly. Therefore, when the magnetic element is subjected to temperature load, it is possible to prevent that a change is generated in percentage of contact around minute dent and projection portions on the opposing faces by expansion and contraction of the core members, and various characteristics of the magnetic element vary due to the temperature.

Also, in another invention, in addition to the above-described invention, the temperature characteristics adjusting means is constituted of a solid part made by depositing powder, and the solid part is provided in a close contact state with the opposing faces of the respective core members. With this structure, the solid part made by deposition of powder is provided between the core members opposing each other among the plurality of core members. Accordingly, the core members do not contact each other. Thus, it is possible to prevent occurrence of a situation such that when a plurality of core members contact each other, they contact only partly. Therefore, when the magnetic element is subjected to temperature load, it is possible to prevent that a change is generated in percentage of contact around minute dent and projection portions on the opposing faces by expansion and contraction of the core members, and various characteristics of the magnetic element vary due to the temperature.

Further, the magnetic element according to the present invention is manufactured by a manufacturing method which includes the steps of forming a thin film on surfaces of a plurality of core members, attaching on the core members a coil formed by winding a conductor, holding the core members on which thin films are formed in the thin film forming step by at least two or more magnetic core holding jigs with the thin films being exposed, contacting the thin films with each other by moving the two or more magnetic core holding jigs closer to each other with the exposed thin films opposing each other and pressing the opposing thin films against each other, and fusing the thin films in contact with each other together by giving vibration to the core members via the magnetic core holding jigs after the contacting step.

By adopting such a manufacturing method, in the magnetic element, the thin films formed on the core members are thermally fused by applying vibration to the core members in a state that the core members are pressed against each other. Therefore, after the fusing is completed, the thin films are fixed together without having unevenness, so that winding of a tape on individual butted core members in the magnetic element for fixing them is no longer necessary, and thus the number of processes can be reduced. Also, by allowing the magnetic core holding jigs to hold a large number of core members, fusing in large quantity can be carried out, which enables mass production of the magnetic element. Therefore, considerable reduction in the number of manufacturing processes, process time and costs becomes possible.

According to the present invention, it is possible to stabilize temperature characteristics in various characteristics of the magnetic element.

DETAILED DESCRIPTION OF THE PREFERRED EMBODIMENTS

Figure 1A:
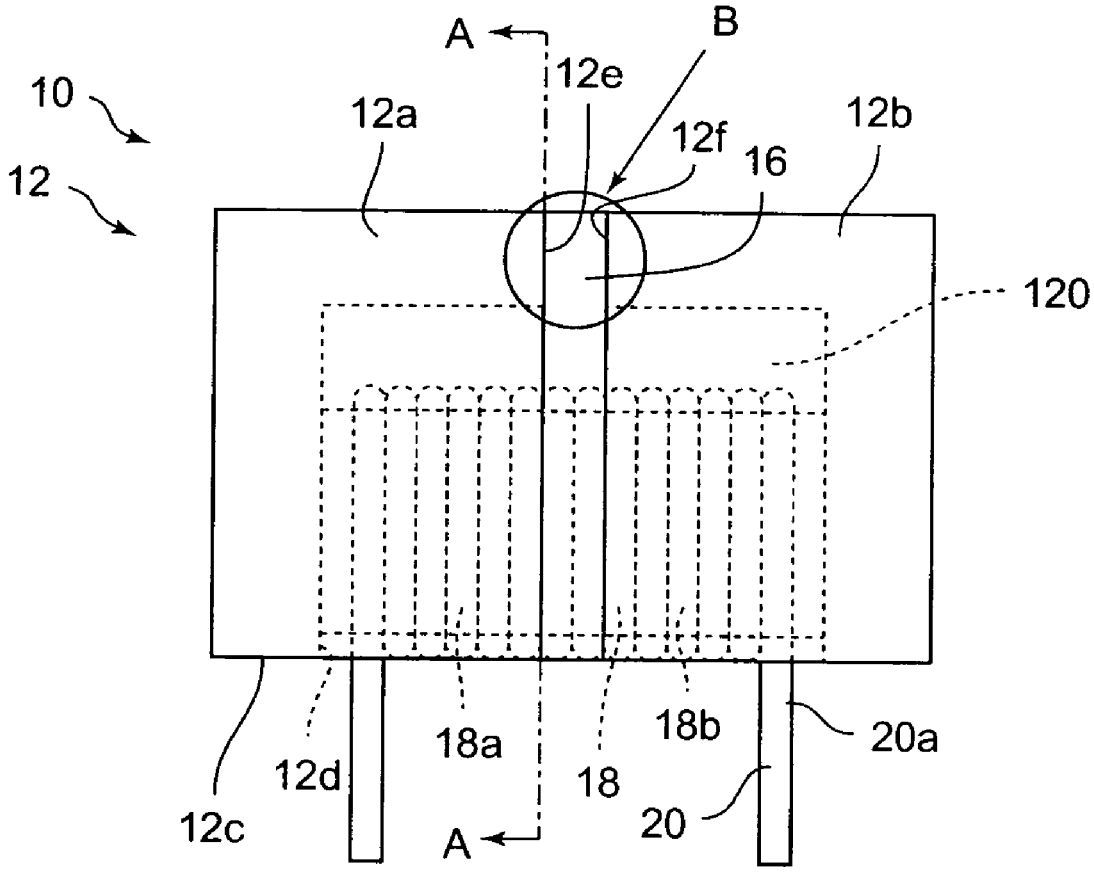
FIG. 1A is a transparent view showing a structure of a magnetic element according to first to third embodiments of the present invention seen from a side face thereof.
Figure 1B:
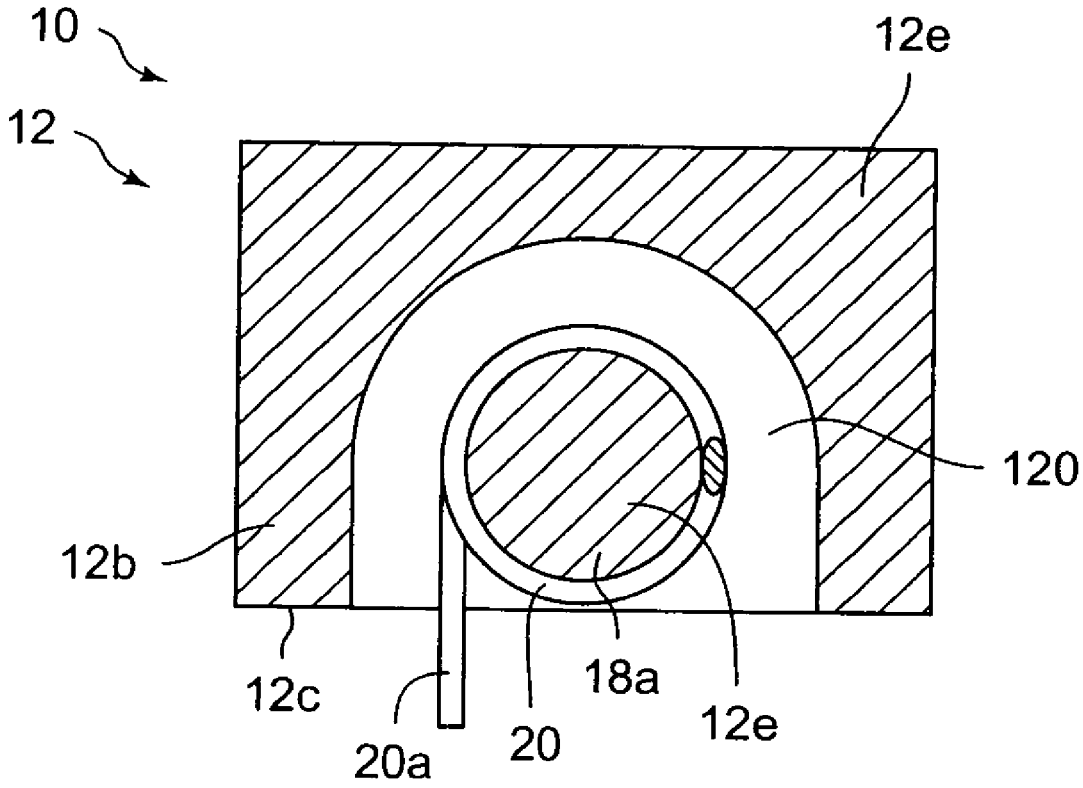
FIG. 1B is a cross sectional view taken along an A-A line in FIG. 1A and seen from a front direction.
Figure 2:
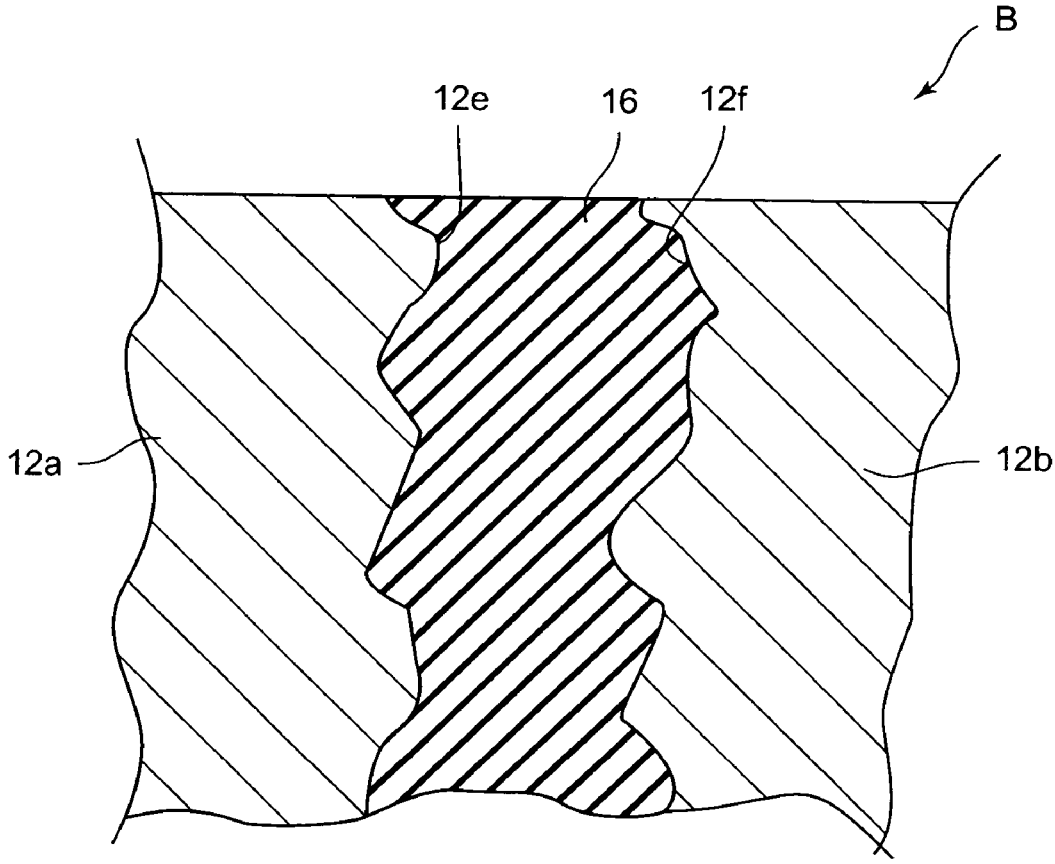
FIG. 2 is an enlarged view of a part of the magnetic element shown by an arrow B in FIG. 1A.

Hereinafter, a magnetic element 10 according to a first embodiment of the present invention will be described based on FIG. 1A and FIG. 1B and FIG. 2. FIG. 1A and FIG. 1B are views showing a structure of the magnetic element 10 according to the first embodiment of the present invention, FIG. 1A being a transparent view seen from a side face thereof and FIG. 1B being a cross-sectional view taken along an A-A line in FIG. 1A and seen from a front direction. Further, FIG. 2 is an enlarged view of a part shown by an arrow B in FIG. 1A. Also, in FIG. 1A, one end side refers to the right side, and the other end side refers to the left side.

The magnetic element 10 is mainly constituted of, as shown in FIG. 1A, a magnetic core body 12 constituted of two EP cores 12*a*, 12*b* which are horizontally symmetrical, a solid part 16 as a temperature characteristics adjusting means arranged between the EP core 12*a* and the EP core 12*b*, and a coil 20 wound on a magnetic core 18 provided in the magnetic core body 12. Note that the EP cores 12*a*, 12*b* are equivalent to core members, respectively.

The magnetic core body 12 is made by butting the EP cores 12*a*, 12*b* which are horizontally symmetrical. Among them, as shown in FIG. 11A and FIG. 1B, the EP core 12*a* has a shape that is hollowed in a substantially semi-columnar form so that a bottom face 12*c* side and an end face 12*e* on the one end side in FIG. 1A are open (this hollowed portion will be referred to as a recessed portion 120 below). Then, in the recessed portion 120, a magnetic core 18*a* in a columnar shape protrudes from a wall face 12*d* on the other end side toward the end face 12*e* on the one end side. Note that the shape of the EP core 12*b* is horizontally symmetrical to the shape of the EP core 12*a*. In the description below, a magnetic core in the EP core 12*b* equivalent to the magnetic core 18*a* will be referred to as a magnetic core 18*b*.

Further, between the end face 12*e* on the one end side of the EP core 12*a* and the end face 12*f* on the other end side of the EP core 12*b*, the solid part 16 with a thickness dimension ranging from 3 μm to 30 μm is provided.

Specifically, the solid part 16 is in a state of being butted to both the end face 12*e* of the EP core 12*a* and the end face 12*f* of the EP core 12*b*. The solid part 16 is formed of, for example, powder of ceramic material such as alumina, silica or the like, or a thin film of epoxy-based resin, silicon-based resin or the like. Also, the solid part 16 may be of a material other than the above-described ones as long as it is a non-magnetic and insulative material.

Further, the solid part 16 provided in a thin film form is formed by ion plating using a PVD (Physical Vapor Deposition) technique, deposition such as vacuum deposition, ion beam deposition or the like, print coating method, electrostatic painting, electrostatic coating method, or the like. Accordingly, the solid part 16 enters minute dents and projections on the end faces 12*e*, 12*f* to fill them up (refer to FIG. 2). Also, a different technique may be adopted for forming the solid part 16. In this embodiment, on the end face 12*e* of the EP core 12*a*, any one of the above-described techniques is used to form the solid part 16. Then, the EP core 12*a* on which the solid part 16 is formed and the EP core 12*b* on which the solid part 16 is not formed are butted with each other. As shown in FIG. 2, in a state that the EP core 12*a* and the EP core 12*b* are butted with each other, the end face 12*e* is in close contact with the other end side of the solid part 16, and the end face 12*f* is in close contact with the one end side of the solid part 16. Besides, the solid part 16 may be formed only on the end face 12*f*. Furthermore, the solid part 16 may have a half thickness, and then solid parts 16 each having a half thickness may be formed respectively on the end faces 12*e*, 12*f* of the EP cores 12*a*, 12*b*.

Also, on the magnetic core 18 of the magnetic core body 12, a conductor 20*a* is wound, which is covered with an insulative film of enamel or the like. Accordingly, on an outer peripheral surface of the magnetic core 18 (magnetic core 18*a*, magnetic core 18*b*), the coil 20 which excites magnetic flux in the magnetic core body 12 is arranged. Here, in an air-core portion of the coil 20 that is wound in advance for a predetermined number of windings with an air-core, one magnetic core 18*a* (magnetic core 18*b*) is inserted and thereafter the other magnetic core 18*b* (magnetic core 18*a*) is inserted in the air-core portion of the coil 20, and then the EP cores 12*a*, 12*b* are butted with each other to thereby attach the coil 20 to the magnetic core 18. Besides, as a different attaching technique, there is one using a bobbin member. The bobbin member has a winding frame portion, and on both ends of this winding frame portion, flange portions are provided. Furthermore, the bobbin member has an insertion hole in which the magnetic cores 18*a*, 18*b* are inserted. By winding the coil 20 on the winding frame portion of this bobbin member and inserting it through the magnetic cores 18*a*, 18*b* of the EP cores 12*a*, 12*b*, and then butting the EP cores 12*a*, 12*b* with each other, the coil 20 is attached to the magnetic core 18.

Further, after the EP core 12*a* and the EP core 12*b* are butted with each other with the solid part 16 intervening therebetween, the outer periphery of the magnetic element 10 is wrapped by a tape. Thus, the EP core 12*a* and the EP core 12*b* are fixed together. In this manner, the magnetic element 10 is formed.

In the magnetic element 10 with this structure, the solid part 16 is provided between the EP core 12*a* and the EP core 12*b*. Moreover, the EP core 12*a* and the EP core 12*b* are both in a close contact state with the solid part 16. Accordingly, the EP core 12*a* and the EP core 12*b* do not contact each other, which prevents occurrence of a situation such that they contact each other only partly and thus the ratio of a non-contact part becomes large. The existence of this solid part 16 realizes stabilization of temperature aspects in various characteristics of the magnetic element 10 as compared to the case that the bonding state of the EP cores 12*a*, 12*b* is uncertain (the contact state of microscopic dents and projections of the end faces 12*e*, 12*f* changes due to a temperature change). Also, by ensuring the stabilization of temperature aspects in the various characteristics of the magnetic element 10, dispersion of temperature aspects in various characteristics of a product that is manufactured with the same specification is also improved, and thus the quality of this product can be improved. Furthermore, by limiting the dimension of the solid part 16 to the range of 3 μm to 30 μm, a state that magnetic saturation would not easily occur can be created while suppressing decrease in magnetic permeability, and also, decrease in values such as inductance, impedance, and the like is suppressed.

Further, in the magnetic element 10, the solid part 16 is constituted of a ceramic material or resin material. Therefore, the solid part 16 can be formed using a thin film forming technique, which enables mass production of solid parts 16 having the same quality in a single process. Accordingly, as compared to the case where cutting, grinding, and the like are performed, increase in the number of processes or increase in costs can be suppressed, and at the same time the solid part 16 can be formed with a highly accurate dimension range. Thus, manufacture costs of the magnetic element 10 can be reduced, and the quality of the solid part 16 can be improved.

Further, in the magnetic element 10, the solid part 16 is in direct contact with the end faces 12*e*, 12*f* of the EP cores 12*a*, 12*b*. Accordingly, in the case where the magnetic element 10 is subjected to temperature load (a temperature change occurs therein) and thereby thermal expansion or contraction occurs in the EP cores 12*a*, 12*b*, it is conceivable that the solid part 16 operates to alleviate the thermal expansion or contraction. Thus, the temperature characteristics of the magnetic element 10 become stable, and occurrence of dispersion in the temperature characteristics of the magnetic element 10 can be prevented.

Next, a magnetic element 40 according to a second embodiment of the present invention will be described below. Note that in this embodiment, the schematic structure of the magnetic element 40 is similar to that shown in FIG. 1, and therefore descriptions of which are omitted. Also, the same numerals and symbols are designated to the same members and the same parts as those in the first embodiment, and descriptions of which are omitted or simplified. Note that the second embodiment has a similar structure to that of the first embodiment, and therefore differences from the first embodiment will be described.

Figure 3:
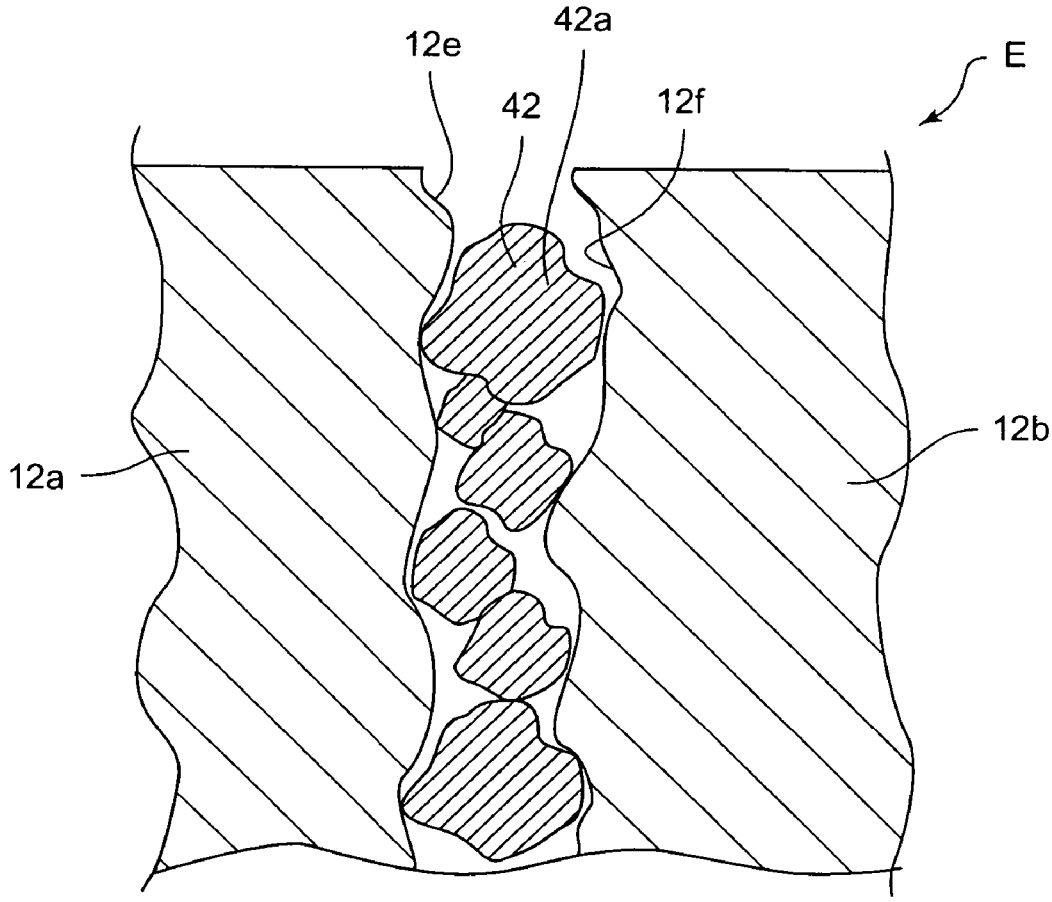
FIG. 3 is an enlarged view of a part of the magnetic element shown by an arrow A in FIG. 1A in a second embodiment of the present invention.
Figure 4:
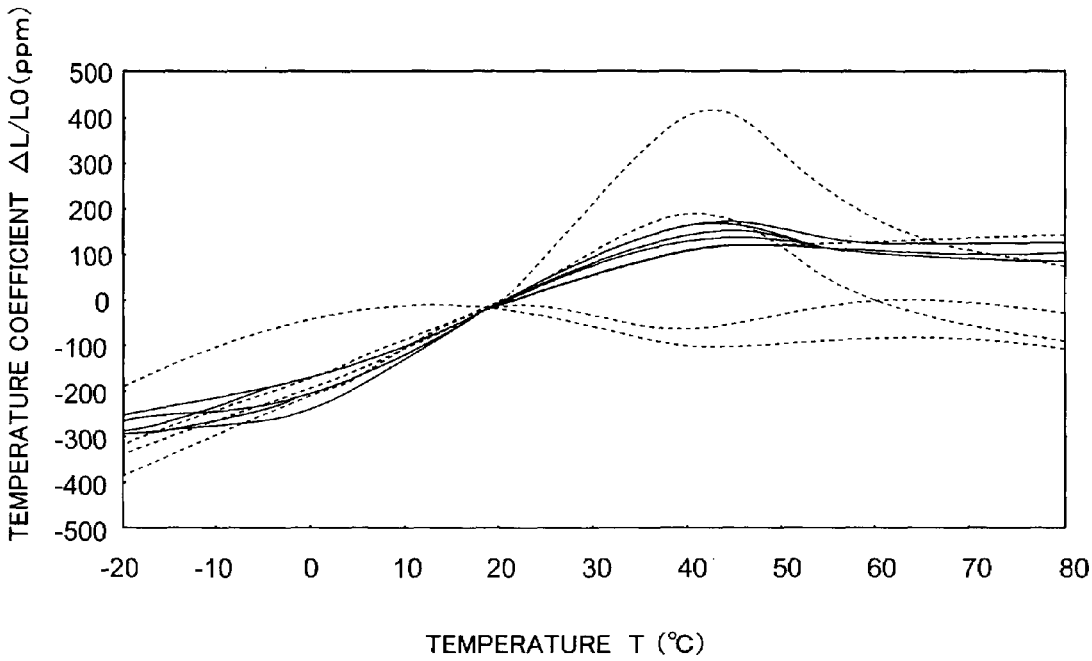
FIG. 4 is a view showing a relationship between temperatures and temperature characteristics of inductance of the magnetic element in the case where powder constituting a solid part is alumina powder having a maximum particle diameter of 15 μm, in the second embodiment of the present invention.

FIG. 3 is an enlarged view of a part shown by the arrow B in FIG. 1A. Further, FIG. 4 is a view showing a relationship between temperatures and temperature characteristics of inductance of the magnetic element 40 in the case where the powder 42*a* constituting the solid part 42 as a temperature characteristics adjusting means is alumina powder having a maximum particle diameter of 15 μm.

Note that the magnetic element 40 has a solid part 42 having a microscopic structure that is different from that of the solid part 16 in the first embodiment.

In the magnetic element 40, similarly to the first embodiment, the solid part 42 having a thickness dimension ranging from 3 μm to 30 μm is provided between the end face 12*e* on the one end side of the EP core 12*a* and the end face 12*f* on the other end side of the EP core 12*b*. Here, in the second embodiment, the solid part 42 is made by directly depositing powder with a dimension range of 3 μm to 30 μm on the end face 12*e* on the one end side of the EP core 12*a* and the end face 12*f* on the other end side of the EP core 12*f*. In other words, in a state that the EP core 12*a* and the EP core 12*b* are butted with each other, the solid part 42 is, as shown in FIG. 3, in a state of having a large amount of powder 42*a* deposited directly on the end face 12*e* and the end face 12*f*.

Further, when the magnetic core body 12 is formed by butting the EP core 12*a* and the EP core 12*b*, the powder 42*a* is deposited on either one or both of the EP core 12*a* and the EP core 12*b*, and in this state, the EP core 12*a* and the EP core 12*b* are butted with each other. The powder 42*a* is constituted of, for example, powder of ceramic material such as alumina, silica or the like, or powder of epoxy-based resin, silicon-based resin or the like. Note that the powder 42*a* may be of any other material as long as it is a non-magnetic and insulative material. Also, the shape of powder 42*a* is not limited particularly as long as it has a maximum particle diameter in the range of 3 μm to 30 μm.

Further, the powder 42*a* is deposited on the end face 12*e* and the end face 12*f* by its own adhering force (friction force or the like for example) or by charging the EP core 12*a* and the EP core 12*b* with static electricity. In this embodiment, as shown in FIG. 3, in a state that the EP core 12*a* and the EP core 12*b* are butted with each other, the solid part 42 is in direct contact with the end faces 12*e*, 12*f*. Note that in this embodiment, the powder 42*a* partially contacts the end faces 12*e*, 12*f*. However, also in this embodiment, the end face 12*e* and the end face 12*f* are not in direct contact but in a state of being separated with each other.

Also, in this embodiment, after the EP core 12*a* and the EP core 12*b* are butted with each other to bring the solid part 42 in contact with the end faces 12*e*, 12*f*, the outer periphery of the magnetic element 40 is wrapped with a tape. Thus, the EP core 12*a* and the EP core 12*b* are fixed together.

In the magnetic element 40 with this structure, the magnetic core 12 is provided with the solid part 42 having the powder 42*a* being deposited directly thereon. Moreover, the EP core 12*a* and the EP core 12*b* are provided in a contact state with the solid part 42. Accordingly, the EP core 12*a* and the EP core 12*b* do not contact each other. Thus, it is possible to prevent occurrence of a situation such that the EP core 12*a* and the EP core 12*b* contact each other only partly and thus the ratio of a non-contact part becomes large. This realizes stabilization of temperature characteristics of the magnetic element 40 as compared to the case that the bonding state of the EP cores 12*a*, 12*b* is uncertain. Also, by ensuring the stabilization of temperature characteristics of the magnetic element 40, dispersion in temperature characteristics of a product that is manufactured with the same specification is also improved, and thus the quality of this product can be improved. Furthermore, by limiting the dimension of the solid part 42 and the maximum diameter of the powder 42*a* to the range of 3 μm to 30 μm, a state that magnetic saturation would not easily occur can be created while suppressing decrease in magnetic permeability. Furthermore, decrease in values such as inductance, impedance, and the like is suppressed.

Further, in the magnetic element 40, the solid part 42 is constituted of the powder 42*a* using a material that is ceramics or resin. Therefore, forming of the solid part 42 constituted of the powder 42*a* by means of its adhering force enables mass formation of solid parts 42 having the same quality in a single process. Accordingly, as compared to the case where cutting, grinding, and the like are performed, increase in the number of processes or increase in costs can be prevented, and at the same time the solid part 42 can be formed with a highly accurate dimension range. Thus, manufacture costs of the magnetic element 40 can be reduced, and the quality of the solid part 42 can be improved.

Further, in the magnetic element 40, the solid part 42 is in direct contact with the end faces 12*e*, 12*f*. Accordingly, in the case where the magnetic element 40 is subjected to temperature load (a temperature change occurs therein) and thereby the EP cores 12*a*, 12*b* thermally expand or contract, it is conceivable that the solid part 42 operates to alleviate the thermal expansion or contraction. Thus, the temperature characteristics of the magnetic element 40 become stable, and occurrence of dispersion in the temperature characteristics of the magnetic element 40 can be prevented.

Note that in FIG. 4, a relationship between temperatures and temperature characteristics of inductance of the magnetic element 40 in the case where the maximum particle diameter of the powder 42*a* constituting the solid part 42 is 15 μm, and the powder 42*a* is alumina powder. Here, dashed lines represent experimental results of five samples of a conventional product (the solid part 42 is not arranged between magnetic cores, and thus they are butted directly with each other), and solid lines represent experimental results of five samples of the magnetic element 40 having the solid part 42 constituted of the above-described alumina powder. These results show that in each sample of the conventional product, temperature characteristics of inductance are largely different, and the characteristics are unstable particularly under an environment with a temperature of 20° C. or higher where temperature load becomes large. On the other hand, regarding the five samples of the magnetic element 40, curves showing characteristics are approximately the same, and thus the quality thereof is stable.

Based on the results of FIG. 4, causes of differences between the conventional products and the magnetic element 40 according to the present invention are considered. On the end faces of the magnetic core, there remain dents and projections resulting from scratching by grinding, baking a surface of magnetic substance, or the like. Here, when the magnetic cores are butted with each other without having the solid part 42, existence of the dents and projections generates a state that a portion where the end faces directly contact with each other and a portion where they do not contact and are separated from each other are mixed. Therefore, when the magnetic core expands or contracts due to heat, a phenomenon occurs such that portions in contact are separated or separated portions come in contact. Moreover, it can be assumed that the portions in contact/separated portions disperse in each magnetic substance. Therefore, it is conceivable that dispersion occurs in variation of the temperature characteristics of inductance.

On the other hand, in the case of the magnetic element 40, as shown in FIG. 3, the solid part 42 is provided between the EP cores 12*a*, 12*b*. Accordingly, direct contact of the EP cores 12*a*, 12*b* with each other can be prevented. Thus, it is possible to prevent occurrence of a condition that the EP cores 12*a*, 12*b* are only partly contact with each other. Also, it is conceivable that the solid part 42 operates to alleviate expansion or contraction of the EP cores 12*a*, 12*b* due to heat, and also operates to separate the EP cores 12*a*, 12*b* with each other by a defined dimension. Also, in FIG. 4, only the temperature characteristic of inductance of the magnetic element 40 is shown, but it is conceivable that stabilization of temperature characteristics of, for example, direct current superposition characteristic, core loss, quality factor, or the like is also obtained.

Next, a magnetic element 60 according to a third embodiment of the present invention will be described below. Note that in this embodiment, the schematic structure of the magnetic element 60 is similar to that shown in FIG. 1, and therefore descriptions of which are omitted. Also, the same numerals and symbols are designated to the same members and the same parts as those in the first embodiment, and descriptions of which are omitted or simplified.

Note that the magnetic element 60 of the third embodiment has a similar structure to that of the magnetic element 10 of the first embodiment, and therefore only differences from the first embodiment will be described. Also, the same numerals and symbols are designated to the same members and the same parts as those in the first embodiment, and descriptions of which are omitted or simplified. Note that the third embodiment has a similar structure to that of the first embodiment, and therefore differences from the first embodiment will be described.

Figure 5A:
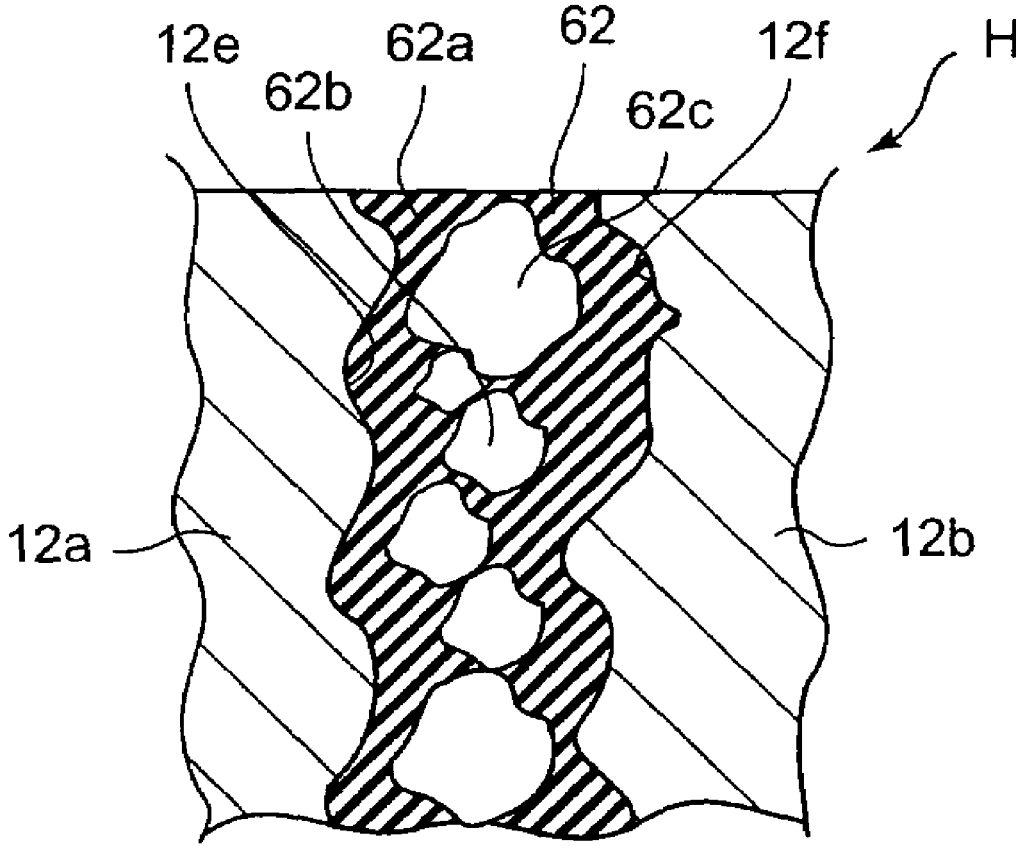
FIG. 5A is an enlarged view of the part shown by the arrow A in the case where coating parts are formed respectively on EP cores, and powder is deposited on one coating part to form a solid part, in a third embodiment of the present invention.
Figure 5B:
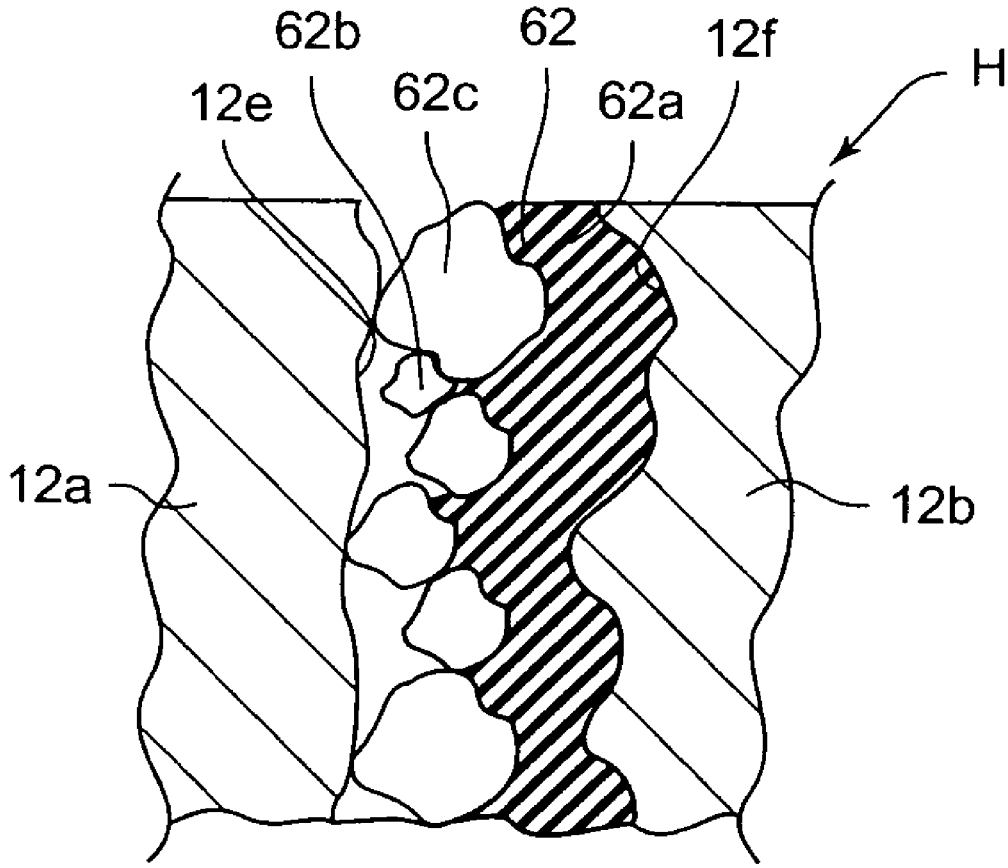
FIG. 5B is an enlarged view of the part shown by the arrow A in the case where the powder is deposited on one of the EP cores and a coating part is formed on the other one to form the solid part, in the third embodiment of the present invention.
Figure 5C:
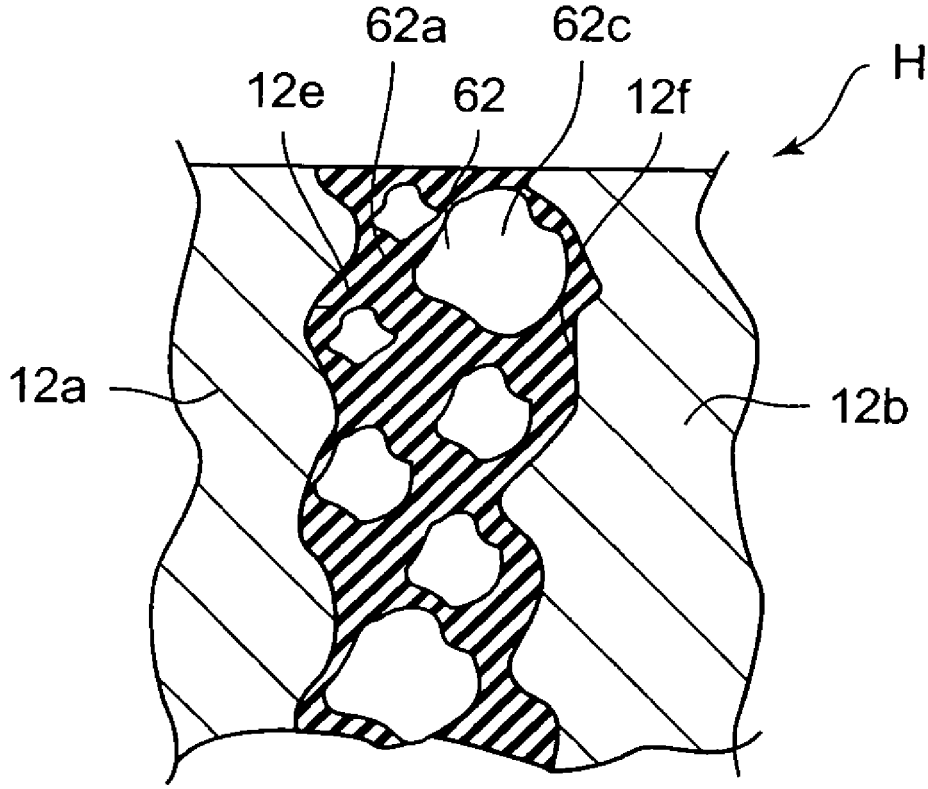
FIG. 5C is an enlarged view of the part shown by the arrow A in the case where a coating material and the powder are kneaded to form the solid part, in the third embodiment of the present invention.

Further, FIG. 5A to FIG. 5C are enlarged views showing a part shown by the arrow B in FIG. 1A, FIG. 5A being a view showing the case where coating parts 62*a* are formed respectively on the EP cores 12*a*, 12*b* and powder 62*c* is deposited on one of the coating parts 62*a* to form a solid part 62, and FIG. 5B being a view showing the case where the powder 62*c* is deposited on one of the EP cores 12*a*, 12*b* and a coating part 62*a* is formed on the other one thereof to form the solid part 62. FIG. 5C is a view showing the case where a coating material 62*a* and the powder 62*c* are kneaded to form the solid part 62. Also, in FIG. 6A, one end side refers to the right side, and the other end side refers to the left side.

The magnetic element 60 has the solid part 62 as a temperature characteristics adjusting means having a microscopic structure that is different from those of the solid part 16 in the first embodiment and the solid part 42 in the second embodiment.

In this magnetic element 60, similarly to the first embodiment, the solid part 62 having a thickness dimension ranging from 3 μm to 30 μm is provided between the end face 12*e* on the one end side of the EP core 12*a* and the end face 12*f* on the other end side of the EP core 12*b*. Here, in this embodiment, the solid part 62 is formed of the coating part 62*a* and powder portion 62*b* with a dimension range of 3 μm to 30 μm, and is categorized in the following three aspects.

In a first aspect, as shown in FIG. 5A, the coating parts 62*a*, 62*a* in a thin film form are formed respectively on the end face 12*e* and the end face 12*f*. Further, after the coating parts 62*a*, 62*a* are formed, the powder 62*c* is deposited on either one of the coating parts 62*a*, 62*a* to thereby form the powder portion 62*b*. Further, after the powder portion 62*b* is formed, the solid part 62 is formed by butting the EP core 12*a* or EP core 12*b* on which only the coating part 62*a* is formed with the EP core 12*b* or EP core 12*a* on which both the coating part 62*a* and the powder portion 62*b* are formed.

In the first aspect, in a state that the EP core 12*a* and the EP core 12*b* are butted with each other, the coating parts 62*a*, 62*a* are in direct contact with the end face 12*e* of the EP core 12*a* and the end face 12*f* of the EP core 12*b* as shown in FIG. 5A. Further, end faces of the coating parts 62*a*, 62*a* are in a state that a large amount of powder 62*c* is deposited thereon. Therefore, the end face 12*e* and the end face 12*f* are in contact in a state that the coating parts 62*a*, 62*a* forming the solid part 62 are in close contact with each other.

In a second aspect, as shown in FIG. 5B, the powder portion 62*b* is formed by depositing the powder 62*c* on the end face 12*e*. Thereafter, the coating part 62*a* to be a thin film is formed on the end face 12*f*. Then, the solid part 62 is formed by butting the EP core 12*a* on which the powder portion 62*b* is formed with the EP core 12*b* on which the coating part 62*a* is formed. As shown in FIG. 5B, in the second aspect, in a state that the EP core 12*a* and the EP core 12*b* are butted with each other, the powder portion 62*b* is in direct contact with the end face 12*e*, and the coating part 62*a* is in direct contact with the end face 12*f*. Also, an end face of the coating part 62*a* on the side facing the EP core 12*a* is in a state that a large amount of powder 62*c* is in contact therewith.

In a third aspect, as shown in FIG. 5C, first a coating material and the powder 62*c* are kneaded to form a kneaded material. The coating material has fluidity and forms the coating part 62*a* after curing. After such a kneaded material is formed, a print coating method is used to form a coating film of the kneaded material on either one of the end face 12*e* or the end face 12*e*. Thereafter, the EP core 12*a* or the EP core 12*b* on which the coating film is formed is butted with the EP core 12*b* or the EP core 12*a* on which the coating film is not formed, thereby forming the solid part 62. As shown in FIG. SC, in the third aspect, in a state that the EP core 12*a* and the EP core 12*b* are butted with each other, the solid part 62 is in direct contact with the end face 12*e* and the end face 12*f*, but this solid part 62 is in a state that the powder 62*c* is mixed in the coating part 62*a*. Note that the solid part 62 may be formed by forming coating films of the kneaded material on both the end face 12*e* and the end face 12*f* respectively so that the thickness of each coating film of the kneaded material becomes half, and thereafter butting with each other the EP core 12*a* and the EP core 12*b* on which the coating films are formed.

In the above-described first to third aspects, for the coating part 62*a* forming the solid part 62, various resin materials can be used, such as epoxy resin, acrylic resin, or the like, which have fluidity. For the powder 62*c* forming the powder portion 62*b*, similarly to the cases of first and second embodiments, powder of ceramic material such as alumina, silica or the like or powder of epoxy-based resin, silicon-based resin or the like for example can be used. Note that materials for the coating part 62*a* and the powder portion 62*b* which constitute the solid part 62 are not limited to the above materials, which may be different ones as long as they are non-magnetic and insulative materials. Further, a positional relationship and an arrangement structure for the coating part 62*a* and the powder portion 62*b* are not particularly limited as long as they are ones described in the first to third aspects and the solid part 62 has a dimension range of 3 μm to 30 μm.

Further, a thin film to be the coating part 62*a* may be formed not only by the print coating method, but also by deposition such as PVD, ion-plating or the like, electrostatic painting, electrostatic coating method, or the like. Also, as long as a thin film can be formed, it is not limited to the above-described means, and other means may be adopted. Further, the powder 62*c* is deposited on the end face 12*e*, end face 12*f*, or the end face of the coating part 62*a* by its own adhering force (friction force or the like for example) or by charging the EP core 12*a* and the EP core 12*b* with static electricity.

Also in this embodiment, after the EP core 12*a* and the EP core 12*b* are butted with each other, the outer periphery of the magnetic element 60 is wrapped with a tape, thereby fixing the EP core 12*a* and the EP core 12*b* together.

In the magnetic element 60 with this structure, the magnetic core 12 is provided with the solid part 62. Also, in the above-described three aspects, a side face of the solid part 62 is any one of the coating part 62*a*, the powder portion 62*b*, and the kneaded material, and the end faces 12*e*, 12*f* are in contact with the side face of the solid portion 62, which is any one of the above-described ones. Also in this case, the butted EP cores 12*a*, 12*b* are in direct contact with side faces of the solid part 62, so that the EP core 12*a* and the EP core 12*b* do not directly contact each other. Thus, it is possible to prevent occurrence of a situation such that, as in conventional arts, the EP core 12*a* and the EP core 12*b* contact each other only partly. Therefore, temperature characteristics of the magnetic element 60 can be stabilized as compared to the case where the bonding state of EP cores 12*a*, 12*b* is uncertain.

Also, by ensuring stabilization of temperature characteristics of the magnetic core 60, dispersion in temperature characteristics of a product manufactured with the same specification is improved, and thus the quality of this product can be improved. Furthermore, by limiting the dimension of the solid part 62 and the maximum diameter of the powder 62*c* to the range of 3 μm to 30 μm, a state that magnetic saturation would not easily occur can be created while suppressing decrease in magnetic permeability. In addition, decrease in values such as inductance, impedance, and the like is suppressed.

Further, in the magnetic element 60, the solid part 62 is in direct contact with the end faces 12*e*, 12*f* of the EP cores 12*a*, 12*b*. Accordingly, even when the magnetic element 60 is subjected to temperature load (a temperature change occurs therein) and thereby the EP cores 12*a*, 12*b* thermally expand or contract, it is conceivable that the solid part 62 operates to alleviate the thermal expansion or contraction. Thus, stable temperature characteristics can be obtained, and occurrence of dispersion in the temperature characteristics of the magnetic element 60 can be prevented.

Figure 6A:
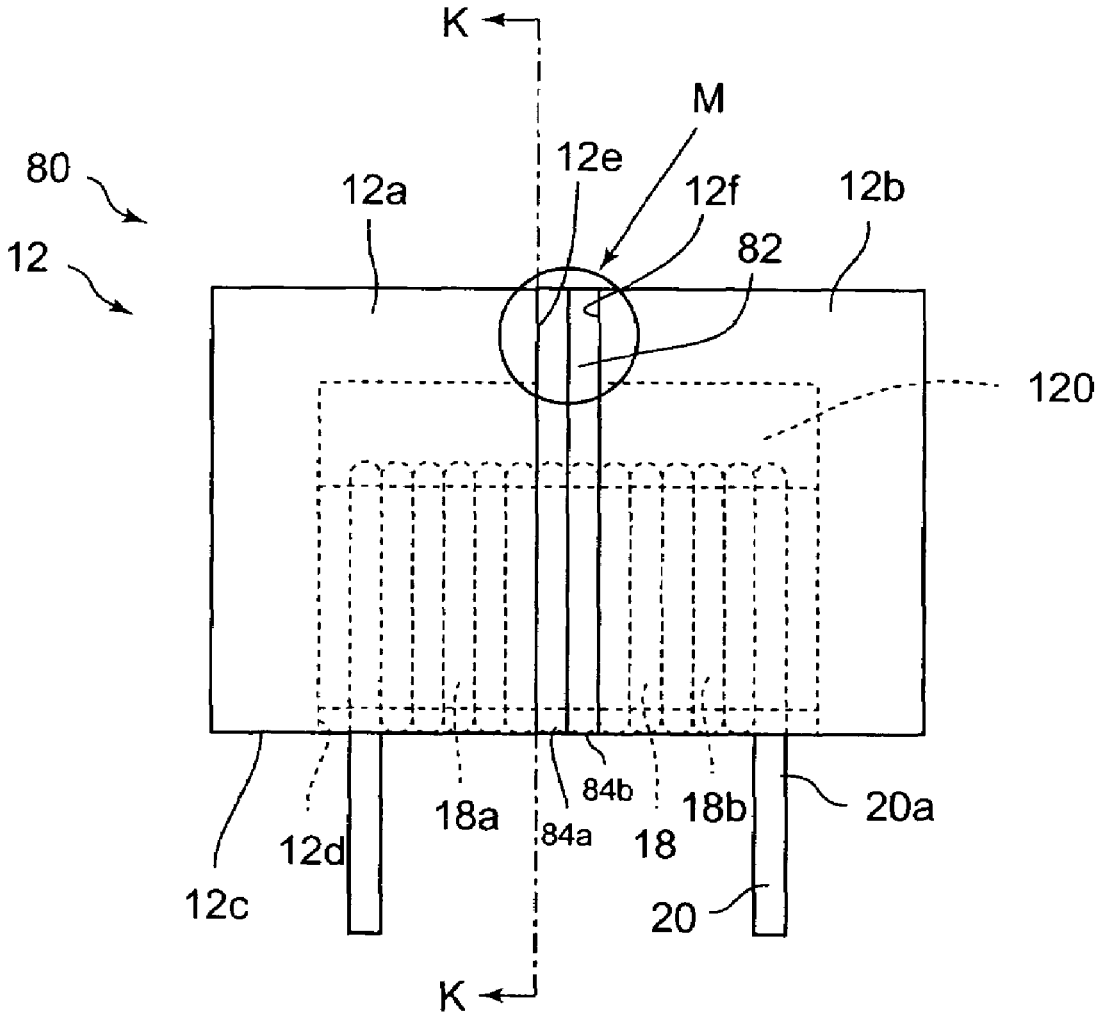
FIG. 6A is a transparent view showing a structure of a magnetic element according to a fourth embodiment of the present invention seen from a side face thereof.
Figure 6B:
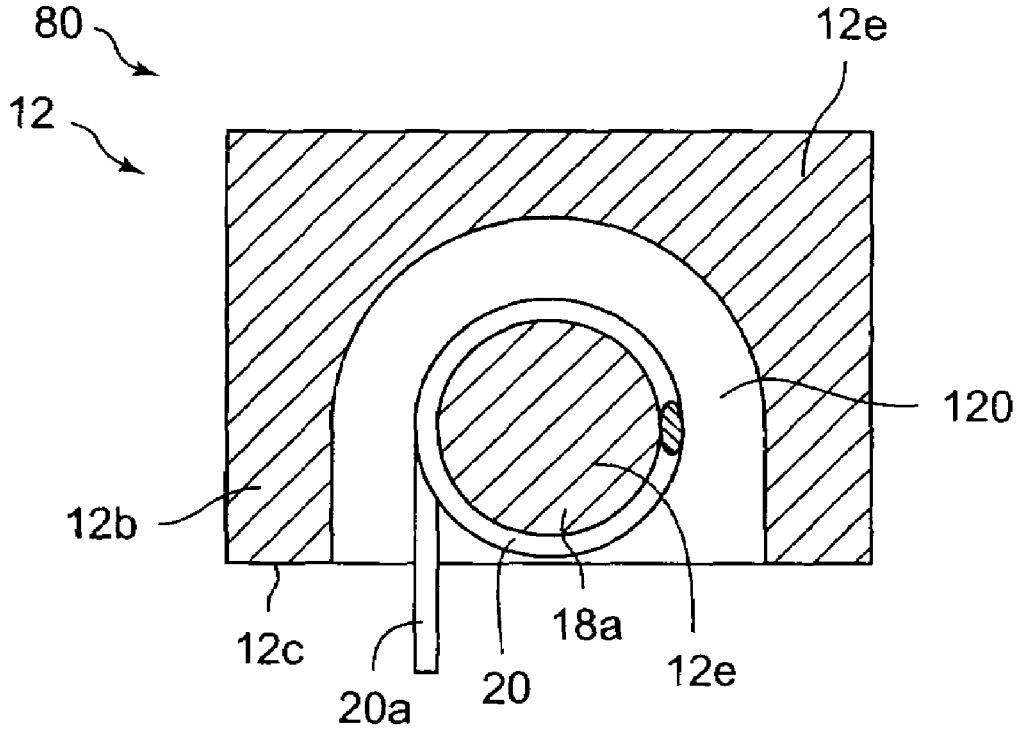
FIG. 6B is a cross-sectional view taken along a K-K line in FIG. 6A and seen from a front direction.
Figure 7:
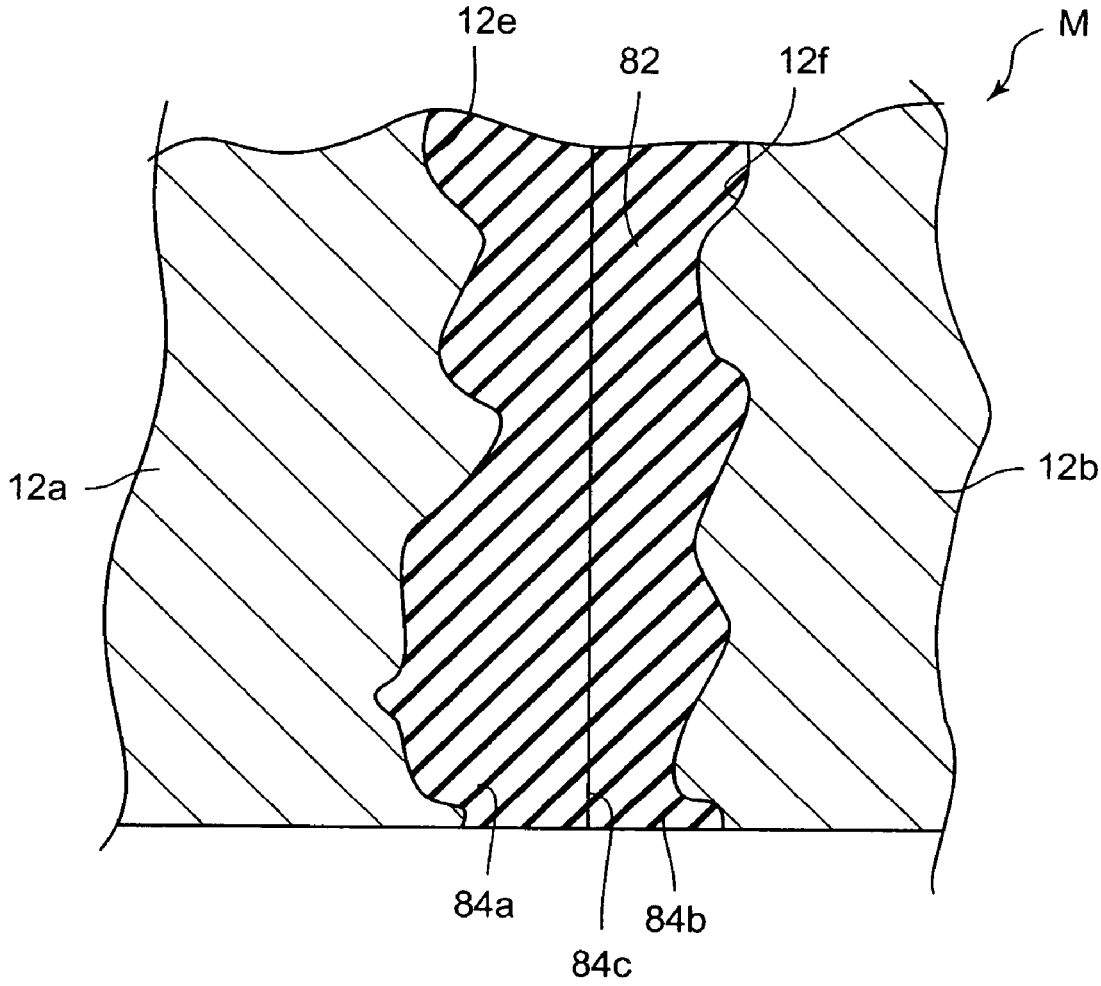
FIG. 7 is an enlarged view of a part of the magnetic element shown by an arrow M in FIG. 6A.
Figure 8:
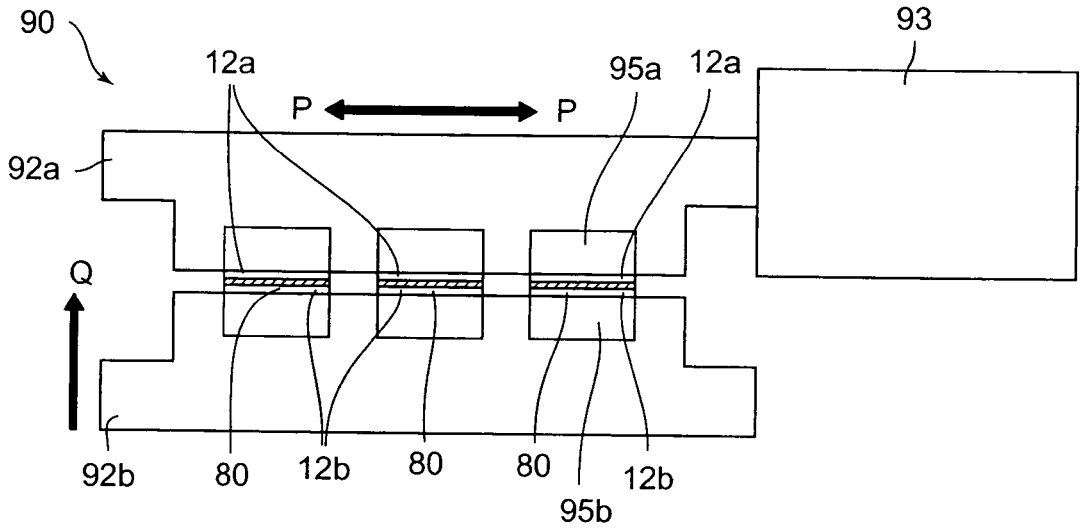
FIG. 8 is a schematic view showing the process of manufacturing the magnetic element by means of ultrasonic fusing.

Next, a magnetic element 80 according to a fourth embodiment of the present invention will be described based on FIG. 6A and FIG. 6B to FIG. 8. FIG. 6A and FIG. 6B are views showing a structure of the magnetic element 80 according to the fourth embodiment of the present invention, FIG. 6A being a transparent view seen from a side face thereof and FIG. 6B being a cross sectional view taken along a K-K line in FIG. 6A and seen from a front direction. Further, FIG. 7 is an enlarged view of a part shown by an arrow M in FIG. 6A, and FIG. 8 is a schematic view showing an overview of manufacturing the magnetic element 80 using an ultrasonic fusing apparatus 90. Also, the same numerals and symbols are designated to the same members and the same parts as those in the first embodiment, and descriptions of which are omitted or simplified. Note that the fourth embodiment has a similar structure to that of the first embodiment, and therefore differences from the first embodiment will be described. Also, in FIG. 6A and FIG. 8, one end side refers to the right side, and the other end side refers to the left side.

The magnetic element 80 has a solid part 82 as a temperature characteristics adjusting means having a microscopic structure that is different from that of the solid part 16 in the first embodiment.

Also in the magnetic element 80, similarly to the first embodiment, the solid part 82 having a gap with a thickness dimension ranging from 3 μm to 30 μm is provided between the end face 12*e* on the one end side of the EP core 12*a* and the end face 12*f* on the other end side of the EP core 12*b*. In this embodiment, the solid part 82 is formed from thin film parts 84*a*, 84*b* each having a thickness that is half of a dimension range of 3 μm to 30 μm. The thin film parts 84*a*, 84*b* are formed respectively on the end face 12*e* and the end face 12*f* by a technique such as deposition.

As shown in FIG. 7, in this embodiment, when the EP core 12*a* and the EP core 12*b* are bonded together, the thin film part 84*a* and the thin film part 84*b* are butted with each other, and in this butting state (contact state), ultrasonic fusing is used. A method of ultrasonic fusing adopted in this embodiment is a friction fusing using ultrasonic vibration, and specifically, as shown in FIG. 7, the ultrasonic vibration is applied to the EP core 12*a* and the EP core 12*b* in a state that the thin film part 84*a* and the thin film part 84*b* are in contact with each other. This ultrasonic vibration generates friction heat at the interface 84*c* between the thin film parts 84*a*, 84*b*, and due to this friction heat, the thin film part 84*a* and the thin film part 84*b* fuse together. Thus, the thin film part 84*a* and the thin film part 84*b* are bonded together strongly without having unevenness.

In this embodiment, materials for the thin film parts 84*a*, 84*b* forming the solid part 82 are both epoxy-based resin, and the thin films 84*a*, 84*b* are formed together by deposition method on the end faces 12*e*, 12*f* of the EP cores 12*a*, 12*b*. Further, a method of forming the thin films 84*a*, 84*b* are not limited to the above-described techniques, where mixture of ceramic powder such as alumina, silica or the like having a predetermined maximum particle diameter with resin material such as epoxy-based resin, silicon-based resin or the like may be formed using a print coating method, electrostatic coating method, or the like for example. Alternatively, beside the above-described techniques, the solid part 82 in a sheet form constituted of the above material may be arranged to be sandwiched at a middle portion between the end faces 12*e*, 12*f* of the EP cores 12*a*, 12*b*. In this case, even when a change in dimension occurs in a resin material and reduces the thickness dimension of the solid part 82 due to generation of friction heat by ultrasonic vibration under a pressed state, a change in thickness dimension does not relatively easily occur in the ceramic powder. Therefore, the defined dimension of the solid part 82 can be maintained.

Next, the process of manufacturing the magnetic element 80 using the ultrasonic fusing will be described.

The magnetic element 80 is manufactured using the ultrasonic fusing apparatus 90 shown in FIG. 8. The ultrasonic fusing apparatus 90 is constituted of magnetic core holding jigs 92*a*, 92*b* for holding the EP cores 12*a*, 12*b*, and an ultrasonic vibrator 93 which is attached to the magnetic core holding jig 92*a* and vibrates the magnetic core holding jig 92*a* in a P-P direction shown by an arrow. Further, the magnetic core holding jigs 92*a*, 92*b* are respectively provided with magnetic core holding recessed portions 95*a*, 95*b* for holding the EP core 12*a* or the EP core 12*b*. In FIG. 8, there are provided three each of the magnetic core holding recessed portions 95*a*, 95*b* along a direction in parallel to opposing faces of the magnetic core holding jigs 92*a*, 92*b* opposing each other. Note that the magnetic core holding recessed portion 95*a* and the magnetic core holding recessed portion 95*b* are provided to oppose each other. Also, the numbers of the magnetic core holding recessed portions 95*a*, 95*b* for the respective magnetic core holding jigs 92*a*, 92*b* are not limited to three, and less than or more than three each of them may be provided.

When the above-described magnetic element 80 is manufactured, first the thin film parts 84*a*, 84*b* are formed by a technique such as deposition on the end faces 12*e*, 12*f* of the EP core 12*a*, respectively (this is equivalent to the thin film forming step). Furthermore, a coil 20 being wound is attached on either one of the EP cores 12*a*, 12*b* (this is equivalent to the coil attaching step). Thereafter, the magnetic core holding recessed portion 95*a* holds one of the EP core 12*a* and the EP core 12*b*, and the magnetic core holding recessed portion 95*b* holds the other remaining one of the EP core 12*a* and the EP core 12*b* (this is equivalent to the holding step). Then, the EP core 12*a* and the EP core 12*b* are opposed to each other, and moreover the thin film parts 84*a*, 84*b* are brought into contact with each other with a pressure being applied in the direction of an arrow Q (this is equivalent to the contacting step).

In this state, ultrasonic vibration is applied by the ultrasonic vibrator 93 in the P-P direction shown by the arrow. This generates friction heat at a position where the thin films 84*a*, 84*b* contact each other, and the thin film parts 84*a*, 84*b* fuse together (this is equivalent to the fusing step). Note that in this embodiment, by way of example, an ultrasonic frequency in the direction P-P shown by the arrow is 19.15 kHz, and a processing time for ultrasonic fusing is 0.2 seconds to 0.3 seconds. Also, pressing force in the direction Q shown by the arrow is 0.1 MPa to 0.2 MPa, and the amplitude of the ultrasonic vibration in the direction P-P shown by the arrow is 20 μm.

In the magnetic element 80 with this structure, the thin film parts 84*a*, 84*b* are thermally fused by applying ultrasonic vibration. Thus, after the fusing is completed, the thin film part 84*a* and the thin film part 84*b* can be completely fixed without having unevenness. Therefore, in the magnetic element 80, it is not necessary to wrap a tape around the individual EP cores 12*a*, 12*b* for fixing them, so that the number of steps can be reduced. Specifically, it is possible to carry out ultrasonic fusing with the magnetic core holding jigs 92*a*, 92*b* of the ultrasonic fusing apparatus 90 holding the EP cores 12*a*, 12*b* in large quantity, thereby enabling mass production of the magnetic element 80. Also, the processing time for ultrasonic fusing is short, which enables considerable reduction in the number of manufacturing steps, process time, and costs.

Thus, the thin film parts 84*a*, 84*b* closely contact with each other without having unevenness, so that a fusing state of the thin film parts 84*a*, 84*b* becomes stable. In addition, a large number of magnetic elements 80 having the same quality can be produced in a short time.

Further, in the magnetic element 80, by using the deposition and fusing, a bonding state of the EP cores 12*a*, 12*b* with the solid part 82 becomes stable. Thus, when temperature load is applied thereto, dimensions of the solid part 82 do not easily change. Therefore, as compared to the case where the magnetic element is fixed by a tape, temperature characteristics of the magnetic element 80 can be improved.

In the foregoing, the respective embodiments of the present invention has been described, but the present invention can be changed in various other ways. This will be described below.

In the above-described respective embodiments, in the magnetic elements 10, 40, 60, 80, the EP cores 12*a*, 12*b* are combined for magnetic core. However, the magnetic core is not limited to the combination of EP cores, where U-shape core and I-shape core, E-shape cores or the like may be combined together. Also, in the respective embodiments, the magnetic elements 10, 40, 60, 80 are made by butting two magnetic cores, the EP cores 12*a*, 12*b*, but the number thereof is not limited to two, where they may be made by butting three or more magnetic cores of other types.

Further, in the first embodiment, the variation example is shown in which the solid parts 16 each having a thickness that is half of a dimension range of 3 μm to 30 μm are formed on the EP cores 12*a*, 12*b*, respectively. Further, in the fourth embodiment, the thin film parts 84*a*, 84*b* each having a thickness that is half of a dimension range of 3 μm to 30 μm are formed on the end faces 12*e*, 12*f* of the EP cores 12*a*, 12*b*, respectively. However, these are not limited to a half thickness, and the ratio of thickness of the solid parts 16 and the thin film parts 84*a*, 84*b* may be a different ratio such as 3:2, 2:1 or the like.

Further, in the first embodiment, the third embodiment, and the fourth embodiment, a technique by means of deposition, print coating, electrostatic painting or electrostatic coating is adopted for forming the solid part 16 or the thin film parts 62*a*, 84*a*, 84*b* on the EP cores 12*a*, 12*b*. However, forming of the solid part 16 or the thin film parts 62*a*, 84*a*, 84*b* is not limited to these techniques, and a different technique such as a chemical vapor growth method, a baking method, sputtering or the like may be used to form the thin films.

Further, in the fourth embodiment, values of the ultrasonic frequency, the processing time for ultrasonic fusing and the pressing force are 19.15 kHz, 0.2 seconds to 0.3 seconds, and 0.1 MPa to 0.2 MPa, respectively. However, they are not limited to these values, where the ultrasonic frequency may range from 17 Hz to 21 Hz, the processing time for ultrasonic fusing may be 0.1 seconds to 0.5 seconds, and the pressing force may range from 0.05 MPa to 0.4 MPa, to thereby combine these respective values.

The magnetic element and the method of manufacturing the magnetic element according to the present invention may be used in various types of electronic parts such as inductances, transformers, filters, and the like.

What is claimed is:

1. A magnetic element, comprising:

a coil formed by winding a conductor;

a plurality of core members constituted of a magnetic material and passing magnetic flux generated by said coil; and a temperature characteristics adjusting means provided between core members opposing each other among said plurality of core members, said means comprising of a non magnetic and insulative material, wherein said temperature characteristics adjusting means is in contact with opposing faces of said respective opposing core members, and said temperature characteristics adjusting means is provided with a thickness dimension ranging from 3 μm to 30 μm.

2. The magnetic element according to claim 1, wherein said temperature characteristics adjusting means is constituted of a ceramic material.

3. The magnetic element according to claim 1, wherein said temperature characteristics adjusting means is constituted of a resin material.

4. The magnetic element according to claim 1, wherein said temperature characteristics adjusting means is constituted of a mixed material which is mixed from a ceramic material and a resin material.

5. The magnetic element according to claim 1, wherein said temperature characteristics adjusting means is constituted of a solid part in a thin film form, and the solid part is provided in a close contact state with the opposing faces of said respective core members.

6. The magnetic element according to claim 1, wherein said temperature characteristics adjusting means is constituted of a solid part made by depositing powder, and the solid part is provided in a close contact state with the opposing faces of said respective.

* * * * *